United States Patent [19]

Williamson

[11] 4,093,821

[45] June 6, 1978

[54] SPEECH ANALYZER FOR ANALYZING PITCH OR FREQUENCY PERTURBATIONS IN INDIVIDUAL SPEECH PATTERN TO DETERMINE THE EMOTIONAL STATE OF THE PERSON

[76] Inventor: John Decatur Williamson, Box 763, Theodore, Ala. 36582

[21] Appl. No.: 806,497

[22] Filed: June 14, 1977

[51] Int. Cl.[2] ..... G10L 1/00

[52] U.S. Cl. ..... 179/1 SC; 128/2 R; 179/1 MN; 179/1 SP

[58] Field of Search ..... 179/1 SA, 1 SC, 1 MN; 128/2 R, 2.06, 2 K; 35/21

[56] References Cited

U.S. PATENT DOCUMENTS 3,971,034 7/1976 Bell et al. ..... 346/1

*Primary Examiner*—Kathleen H. Claffy
*Assistant Examiner*—E. S. Kemeny
*Attorney, Agent, or Firm*—Armstrong, Nikaido, Marmelstein & Kubovcik

[57] ABSTRACT

A speech analyzer is provided for determining the emotional state of a person by analyzing pitch or frequency perturbations in the speech pattern. The analzyer determines null points or "flat" spots in an FM demodulated speech signal and produces a first output indicative of the nulls and a second output indicative of the presence of a "word." A pitch frequency processor receives the FM demodulated speech signal and the first output of the detector means and produces an output having an amplitude proportional to the frequency of the speech signal at the null. A pitch null duration processor receives the first output of the detector means and produces an output having an amplitude proportional to the duration of the nulls. A ratio processor receives the first and second outputs of the detector means and produces an output proportional to the ratio of the total duration of all the nulls within a word to the total duration of the word. The outputs of the pitch frequency processor, pitch null duration processor and ratio processor can be used to provide an indication of the emotional state of the individual whose speech is being analyzed.

12 Claims, 39 Drawing Figures

INTEGRATOR
46
PEAK HOLD AMPLIFIER
48
PULSE GENERATOR
52
DELAY GENERATOR
54
SAMPLE HOLD AMPLIFIER
50
(FIG. 5B)
(FIG. 3F) OR (FIG. 5A)
(FIG. 5E)
(FIG. 5C)
(FIG. 5D)
(FIG. 5F)
SIGNAL TIMING
ON
OFF
10
0

$S_P$ NULL SAMPLE
NULL INTEGRAL
STORED PEAK
NULL INTEGRAL SAMPLE
PEAK HOLD RESET
NULL OUTPUT N

NULL INTEGRATOR
60
WORD INTEGRATOR
56
PULSE GENERATOR
62
DELAY GENERATOR
66
COMPARATOR
58
SAMPLE HOLD CIRCUIT
64
(FIG. 6H)
(FIG. 6F)
(FIG. 6E)
(FIG. 6D)
(FIG. 6C)
(FIG. 6G)
(FIG. 6B) OR (FIG. 3F)
(FIG. 6A) OR (FIG. 3E)
SIGNAL TIMING
$S_W$ WORD SAMPLE
$S_P$ NULL SAMPLE
NULL INTEGRAL
WORD INTEGRAL
END OF WORD
NULL INTEGRAL SAMPLE
INTEGRATOR RESET
RATIO OUTPUT R
OFF ON
ON OFF
1 0

SPEECH ANALYZER FOR ANALYZING PITCH OR FREQUENCY PERTURBATIONS IN INDIVIDUAL SPEECH PATTERN TO DETERMINE THE EMOTIONAL STATE OF THE PERSON

BACKGROUND OF THE INVENTION

1. Field of the Invention

This invention is related to an apparatus for analysing an individual's speech and more particularly, to an apparatus for analysing pitch perturbations to determine the individual emotional state such as stress, depression, anxiety, fear, happiness, etc., which can be indicative of subjective attitudes, character, mental state, physical state, gross behavioral patterns, veracity, etc. In this regard the apparatus has commercial applications as a criminal investigative tool, a medical and/or psychiatric diagnostic aid, a public opinion polling aid, etc.

2. Description of the Prior Art

One type of technique for speech analysis to determine emotional stress is disclosed in Bell Jr., et al., U.S. Pat. No. 3,971,034. In the technique disclosed in this patent a speech signal is processed to produce an FM demodulated speech signal. This FM demodulated signal is recorded on a chart recorder and then is manually analyzed by an operator. This technique has several disadvantages. First, the output is not a real time analysis of the speech signal. Another disadvantage is that the operator must be very highly trained in order to perform a manual analysis of the FM demodulated speech signal and the analysis is a very time consuming endeavor. Still another disadvantage of the technique disclosed in Bell Jr., et al. is that it operates on the fundamental frequencies of the vocal cords and, in the Bell, Jr., et al. technique tedious re-recording and special time expansion of the voice signal are required. In practice, all these factors result in an unnecessarily low sensitivity to the parameter of interest, specifically stress.

Another technique for voice analyzing to determine emotional states is disclosed in Fuller, U.S. Pat. Nos. 3,855,416, 3,855,417, and 3,855,418. The technique disclosed in the Fuller patents analyses amplitude characteristics of a speech signal and operates on distortion products of the fundamental frequency commonly called vibrato and on proportional relationships between various harmonic overtone or higher order formant frequencies.

Although this technique appears to operate in real time, in practice, each voice sample must be calibrated or normalized against each individual for reliable results. Analysis is also limited to the occurrence of stress, and other characteristics of an individual's emotional state cannot be detected.

SUMMARY OF THE INVENTION

The present invention is directed to a method and apparatus for analyzing a person's speech to determine their emotional state. The analyzer operates on the real time frequency or pitch components within the first formant band of human speech. In analysing the speech, the method and apparatus analyze certain value occurrence patterns in terms of differential first formant pitch, rate of change of pitch, duration and time distribution patterns. These factors relate in a complex but very fundamental way to both transient and long term emotional states.

Human speech is initiated by two basic sound generating mechanisms. The vocal cords; thin stretched membranes under muscle control, oscillate when expelled air from the lungs pass through them. They produce a characteristic "buzz" sound at a fundamental frequency between 80 Hertz and 240 Hertz. This frequency is varied over a moderate range of both conscious and unconscious muscle contraction and relaxation. The wave form of the fundamental "buzz" contains many harmonics, some of which excite resonance in various fixed and variable cavities associated with the vocal tract. The second basic sound generated during speech is a psuedo-random noise having a fairly broad and uniform frequency distribution. It is caused by turbulence as expelled air moves through the vocal tract and is called a "hiss" sound. It is modulated, for the most part, by tongue movements and also excites the fixed and variable cavities. It is this complex mixture of "buzz" and "hiss" sounds, shaped and articulated by the resonant cavities, which produces speech.

In an energy distribition analysis of speech sounds, it will be found that the energy falls into distinct frequency bands called formants. There are three significant formants. The system described here utilizes the first formant band which extends from the fundamental "buzz" frequency to approximately 1000 Hertz. This band has not only the highest energy content but reflects a high degree of frequency modulation as a function of various vocal tract and facial muscle tension variations.

In effect, by analyzing certain first formant frequency distribution patterns, a qualitative measure of speech related muscle tension variations and interactions is performed. Since these muscles are predominantly biased and articulated through secondary unconscious processes which are in turn influenced by emotional state, a relative measure of emotional activity can be determined independent of a person's awareness or lack of awareness of that state. Research also bears out a general supposition that since the mechanisms of speech are exceedingly complex and largely autonomous, very few people are able to consciously "project" a fictitious emotional state. In fact, an attempt to do so usually generates its own unique psychological stress "fingerprint" in the voice pattern.

Because of the characteristics of the first formant speech sounds, the method and apparatus of the present invention analyses an FM demodulated first formant speech signal and produces three outputs therefrom.

The first output is indicative of the frequency of nulls or "flat" spots in the FM demodulated signal. Small differences in frequency between short adjacent nulls is indicative of depression or stress, whereas large differences in frequency between adjacent nulls is indicative of looseness or relaxation. The second output is indicative of the duration of the nulls. Generally, the longer the nulls, the higher the stress level. A long null in an output can be used as a flag to indicate the possibility of stress. The third output is proportional to the ratio of the total duration of nulls during a word period to the total length of the word period. A word period is defined as a predetermined period of time in which the speech signal includes components having a frequency above a predetermined frequency.

In general, the ratio measurement discriminates between theatrical emphasis and stress. A more or less continuous high ratio indicates a background state of anger or depression. A low ratio indicates a normal or neutral emotional state.

In the present invention the first formant frequency band of a speech signal is FM demodulated and the FM demodulated signal is applied to a detector which detects nulls or "flat" spots in the FM demodulated signal and produces a first output indicative thereof. The detector also detects the beginning and end of a word and produces a second output indicative thereof. A pitch frequency processor is coupled to the output of the FM demodulator and to the first output of the detector for producing an output having an amplitude proportional to the frequency of the speech signal at the nulls. A pitch null duration processor is coupled to the first output of the detector and produces an output having an amplitude proportional to the duration of the nulls. A ratio processor is coupled to the first and second outputs of the detector for producing an output proportional to the ratio of the total duration of all the nulls within a word to the total duration of the word. The outputs of the pitch frequency, pitch null duration processor and the ratio processor are indicative of the emotional state of the individual whose speech is being analyzed and an operator, merely by looking at these three outputs, can immediately determine the emotional state of the individual.

It is an object of the present invention to provide a method and apparatus for analyzing an individual's speech pattern to determine their emotional state.

It is another object of the present invention to provide a method and apparatus for analyzing an individual's speech to determine the individual's emotional state in real time.

It is still a further object of the present invention to analyze an individual's speech to determine the individual's emotional state by analyzing frequency or pitch perturbations of the individual's speech.

It is still a further object of the present invention to analyse an FM demodulated first formant speech signal to determine the frequency of nulls in the speech signal, the duration of the nulls and the ratio of the total time period of nulls within a word to the duration of the word.

BRIEF DESCRIPTION OF THE DRAWINGS

FIGS. 2A–2E illustrate the electrical signals associated with the elements shown in FIG. 2.

FIGS. 3A–3F illustrate the electrical signals associated with the elements shown in FIG. 3.

FIGS. 4A–4D illustrate the electrical signals associated with the elements shown in FIG. 4.

DETAILED DESCRIPTION OF THE PREFERRED EMBODIMENT

Figure 1:
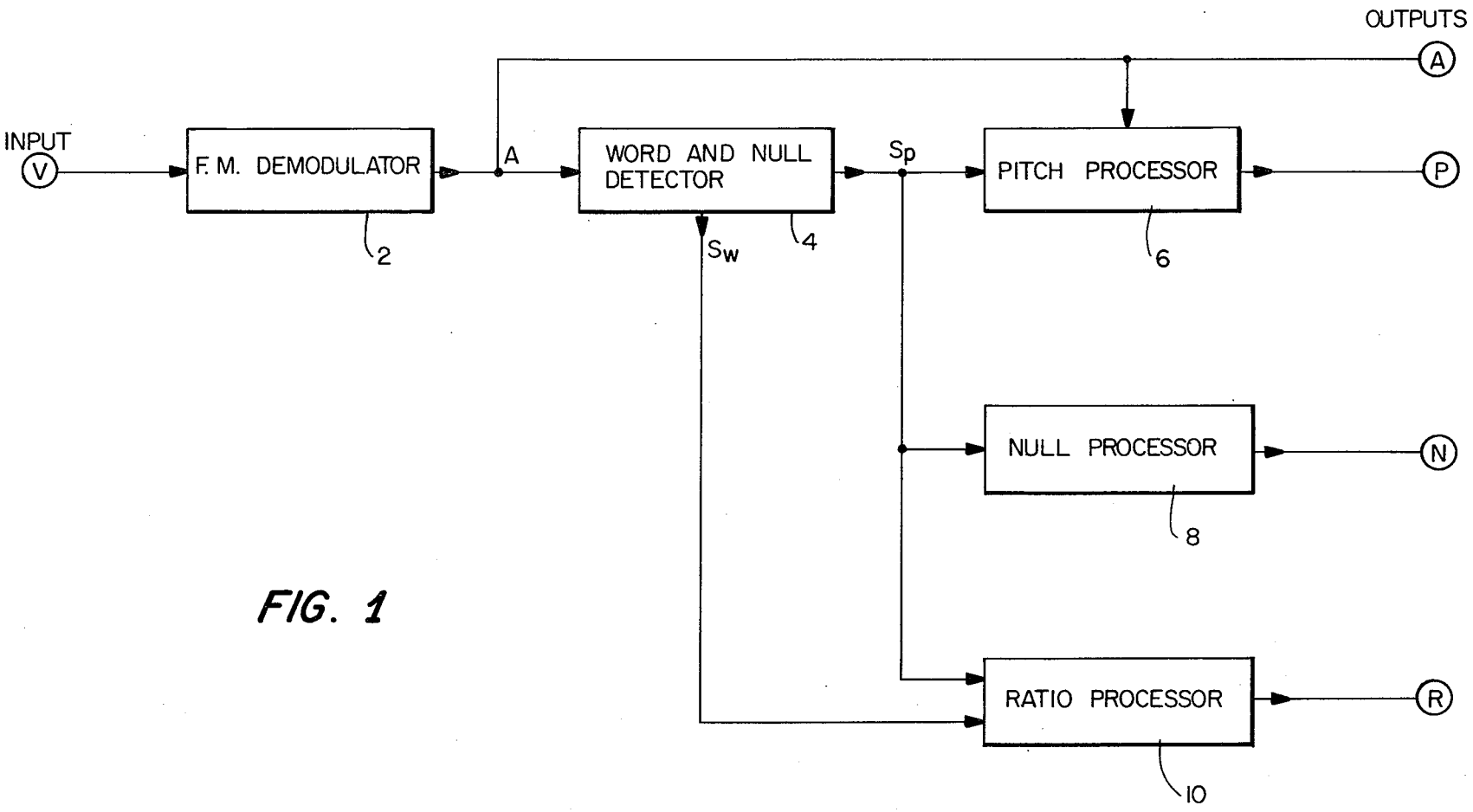
FIG. 1 is a block diagram of the system of the present invention.

Referring to FIG. 1 an input signal V which is a full voice spectrum from any source such as a telephone, tape recording television, radio or directly from an individual through a microphone, is applied to a conventional FM demodulator 2 which produces an output A which is a 0–10 volt signal proportional to the instantaneous voice frequency falling within the range of approximately 250 Hz to 800 Hz which is the first formant band. The demodulated voice signal A is applied to the word and null detector 4 which produces a first output $Sp$ which is a pulse of constant amplitude having a duration proportional to the periods of constant pitch, i.e., nulls in the FM demodulated signal A. The word and null detector 4 also produces a second output $Sw$ which is a pulse of constant amplitude having a duration proportional to the periods of continuous voicing, i.e., words. The voice signal A and the pitch null signal $Sp$ are applied to the pitch frequency processor 6 which produces an output P which is a 0–10 volt signal proportional to the frequency or pitch of the voice signal during the nulls. The null signal $Sp$ is also applied to the pitch null duration processor 8 which produces an output N which is a 0–10 volt signal proportional to the time integral of the null pitch periods. Null signal $Sp$ and word signal $Sw$ are both applied to the ratio processor 10 which produces a 0–10 volt signal proportional to the ratio of the sum of the durations of the nulls in a word period to the ratio of the word period. Signal P, N and R can be applied to any type of output device as, for example, meters, chart recorders, lights, a computer, etc., to provide the system operator with a real time analysis of the emotional state experienced by the person whose voice is being analysed. It should be noted that the voice signal which is analysed does not have to be the answer to questions which is limited to veracity evaluation, but rather can merely be any voice signal from an individual. If the individual experiences stress or other feelings with regard to the subject matter, or to a particular point within the subject matter being spoken about, it will be apparent to the operator by observation of the outputs P, N and R of the present invention. A more sophisticated use of the invention, for example, in conjunction with a computer and routine sampling techniques, might be to assess regional or specific demographic moods or responses to issues or events.

Figure 2:
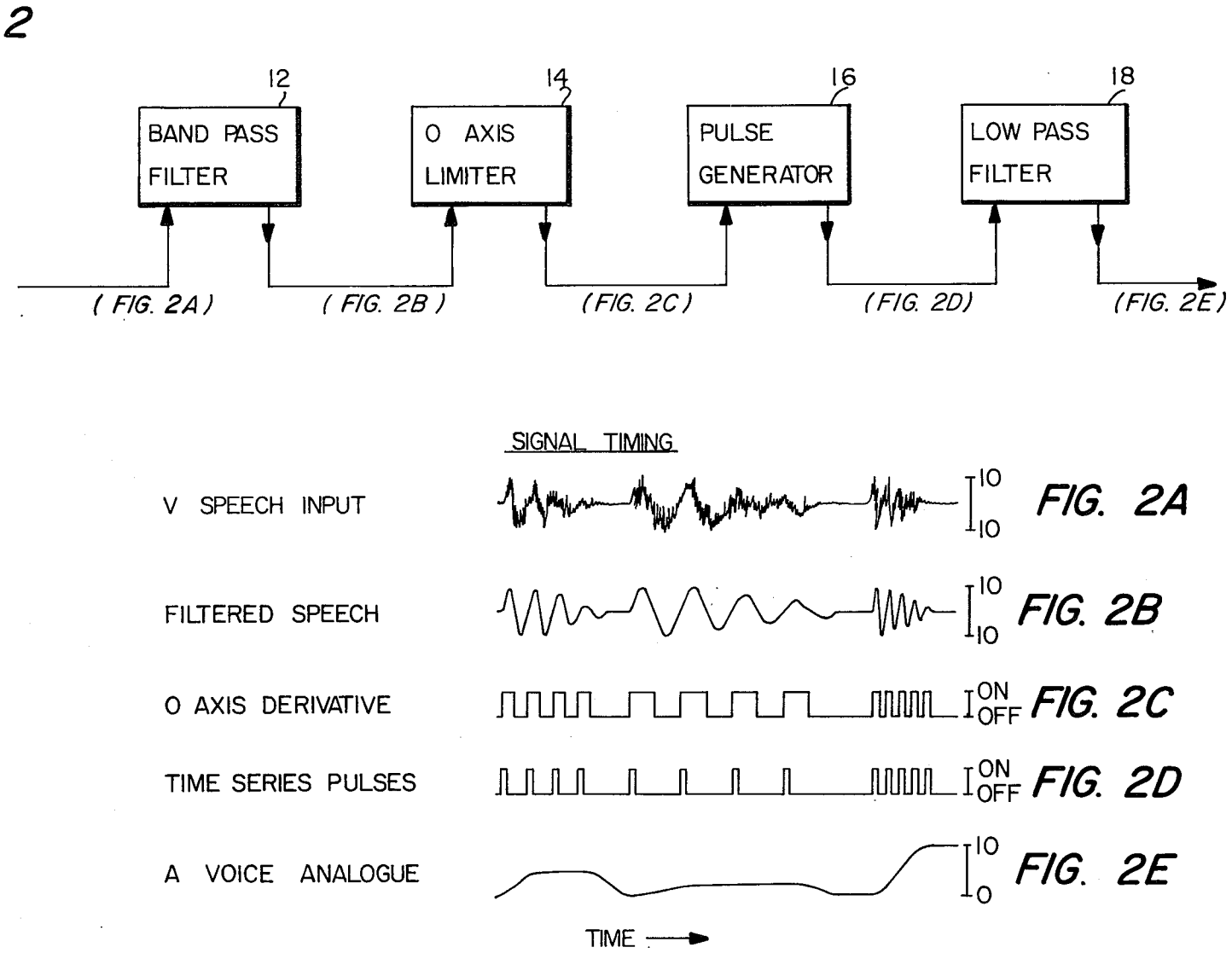
FIG. 2 is a conventional FM demodulator used in conjunction with the present invention.

FIG. 2 illustrates a conventional FM demodulator which can be used in conjunction with the present invention. Input signal V represents a broad band speech signal which is applied to band pass filter 12 which passes frequencies in the first formant. The output of the band pass filter shown in FIG. 2B is applied to a limiter 14 which produces a squared signal having zero crossings corresponding to the zero crossings of the filtered speech signal of FIG. 2B. The squared signal is applied to a pulse generator 16 which produces pulses of a constant width at the leading edge of each of the pulses in the squared signal. The output of the pulse generator which is shown in FIG. 2D is applied to a low pass filter 18 which provides a time integral of the pulses. The output of the low pass filter shown in FIG. 2E corresponds to the FM demodulated speech signal A.

Although an FM demodulator is illustrated, it is possible to produce an FM demodulated voice signal with apparatus remote from the voice analyzer and then take the FM demodulated signal and apply it to the word and null detector and the frequency processor thereby eliminating the FM demodulator.

Figure 3:
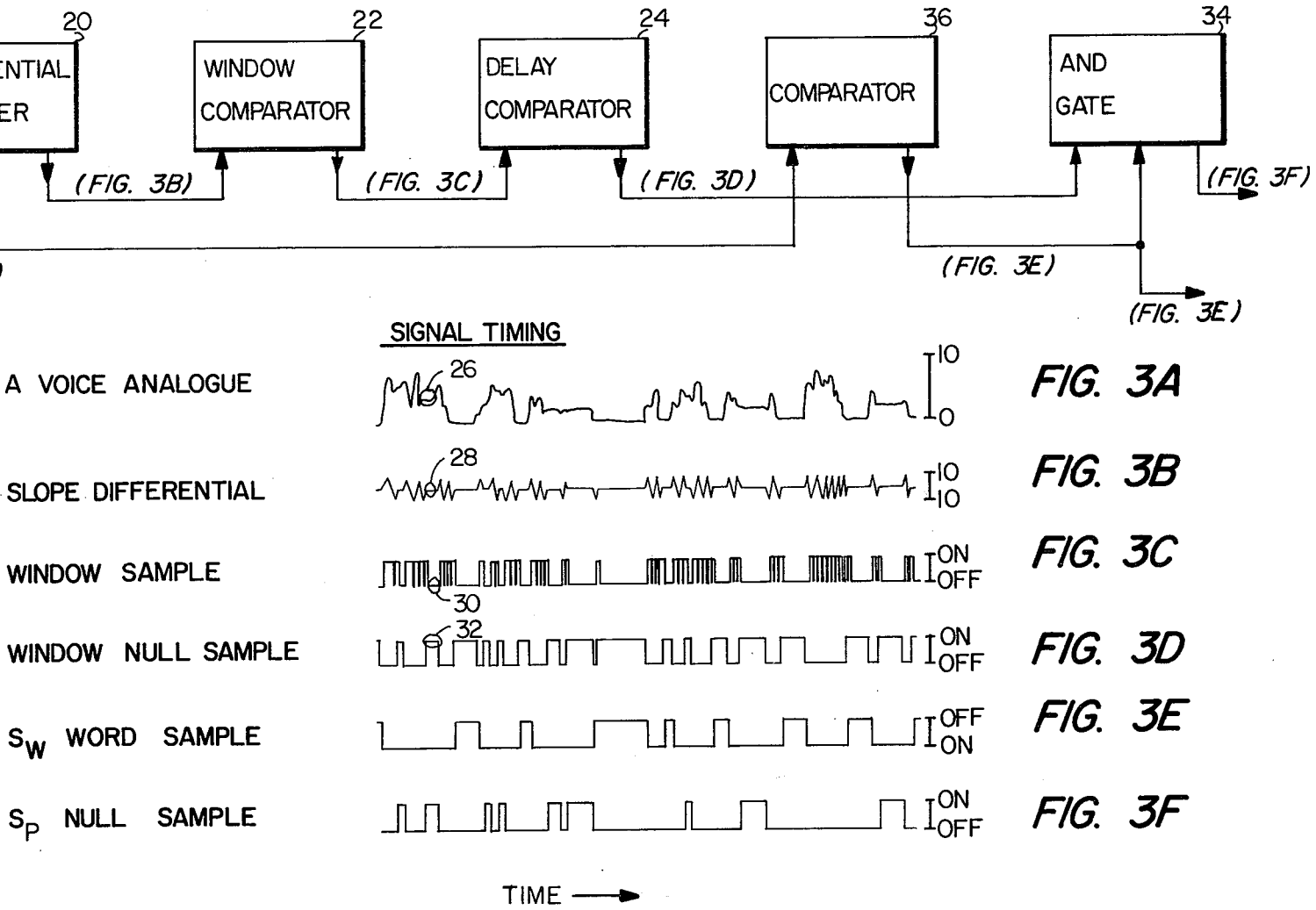
FIG. 3 is a block diagram of the null and word detector of the present invention.

Referring to FIG. 3, the FM demodulated voice signal shown in FIG. 2 and 3, which are the same, is applied to the input of differential amplifier 20 which differentiates the FM demodulated voice signal producing an output shown in FIG. 3B. This signal is applied to window comparator circuit 22 which determines when the output of the differential amplifier 20 is above or below a voltage level which is very close to zero. The window comparator circuit 22 produces an output illustrated in FIG. 3C which is a square wave output each of the pulses having a width corresponding to the time during which the output of the differential amplifier 20 is above or below the predetermined value. The output of the window comparator shown in FIG. 3C is applied to a delay comparator 24 which ignores a return to zero time shorter than a predetermined period of time. Usually, this predetermined period is 40 milliseconds. The output of the delay comparator is illustrated in FIG. 3D.

The purpose of the pitch null detector is to determine periods of constant frequency or pitch in an individual speech. FIG. 3A is an FM demodulated speech signal. Therefore, a flat portion of this signal is indicative of a constant frequency or null. One such point is shown at 26. Flat portion 26 in FIG. 3A would have a zero slope. This is shown in FIG. 3B at 28. The reason for setting the window comparator 22 at values slightly above and below zero is that there is a strong likelihood there will be a small amount of ambient noise so that there will not be a true zero in the signal shown in FIG. 3B. By setting the window comparator 22 at levels slightly above and below zero, the effect of the noise is eliminated. The zero portion 28 in FIG. 3B is illustrated as a zero portion 30 in FIG. 3C. Since the zero portion 30 has a width greater than the predetermined delay of delay comparator 24, at the occurrence of zero portion 30, the delay comparator 24 produces a pulse 32 in FIG. 3D. The output of the delay comparator 24 is applied to one input of AND gate 34.

The demodulated voice signal A is also applied to a comparator 36 which produces an output whenever the amplitude of the FM demodulated signal is at a level representative of a frequency greater than a predetermined frequency as for example, 250 Hz which is the lowest frequency in the first formant of the speech signal. The output of comparator 36, as illustrated in FIG. 3E, is applied to the other input of AND gate 34.

Since a word is defined as being a voice signal which continually has a component above the predetermined frequency, the output of the comparator is indicative of the occurrence of words. The output of AND gate 34 is indicative of nulls or periods of constant pitch or frequency in the voice signal. By applying the output of the comparator 36 to AND gate 34 periods when there is no speech are not seen as nulls in the output of the null detector.

Figure 4:
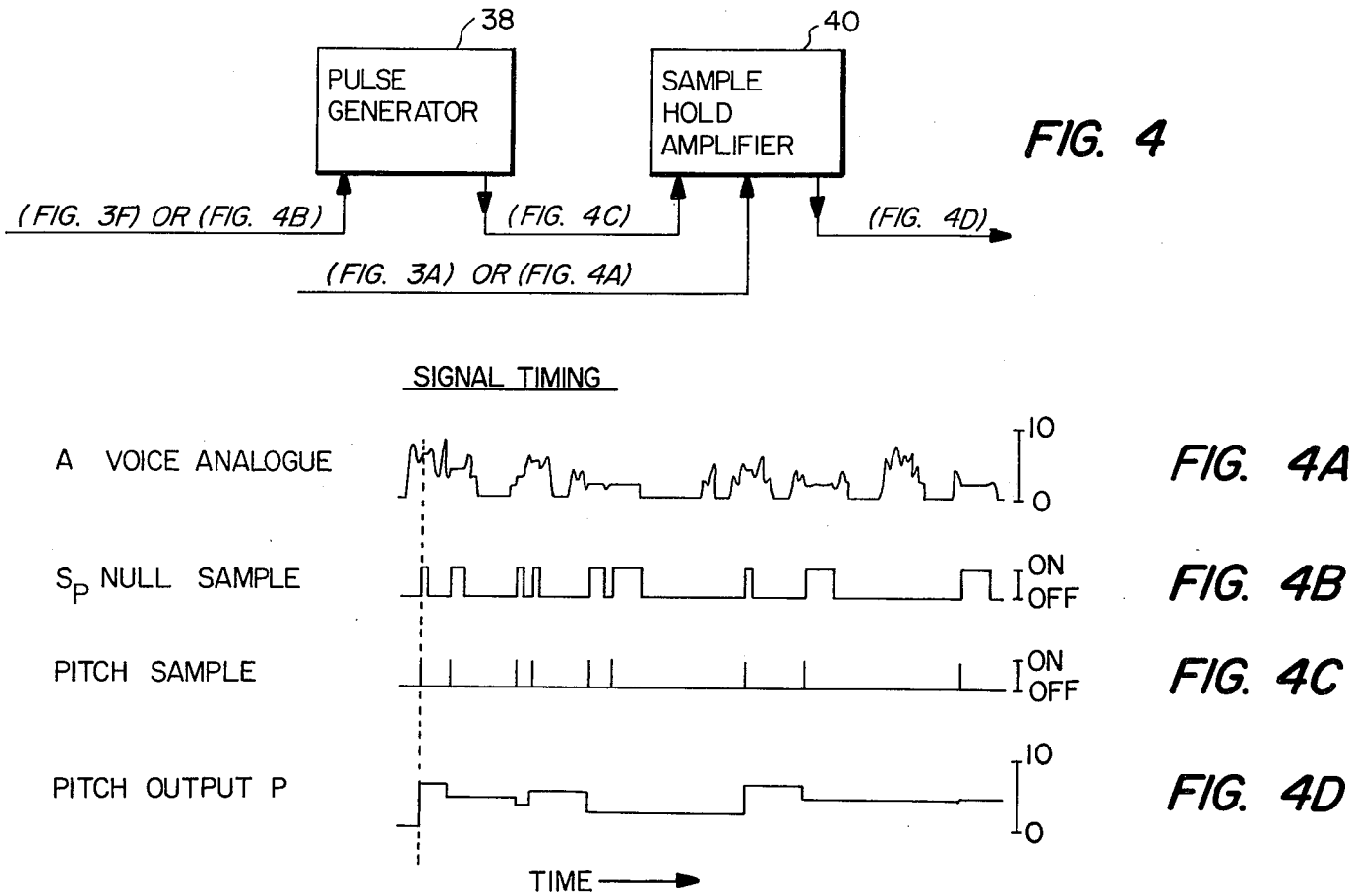
FIG. 4 is a block diagram of the pitch frequency processor of the present invention.

FIG. 4 illustrates the pitch frequency processor of the present invention. The null signal in FIG. 3F which is the same as FIG. 4B, which is one output of the word and null detector illustrated in FIG. 3 is applied from AND gate 34 to the input of pulse generator 38. The pulse generator 38 produces a pulse of a very short duration at the leading edge of each null. The output of the pulse generator, shown in FIG. 4C, is applied to the control input of sample and hold circuit 40. When the control input of sample and hold circuit 40 receives a pulse 42, it samples the amplitude of the FM demodulated voice signal at 44 and holds a signal proportional to the amplitude of the FM demodulated signal. This signal is thus proportional to the frequency or pitch of the voice signal. The output of the sample and hold circuit 40 is illustrated in FIG. 4D. The amplitude of the signal is proportional to the frequency of the nulls in the voice signal and there is a change in the level of the output of the sample and hold circuit at the occurrence of each null. Naturally, if two adjacent nulls occur at the same frequency, there would be no change in the output of the sample and hold circuit.

Figures 5, 5A, 5B, 5C, 5D, 5E, 5F:
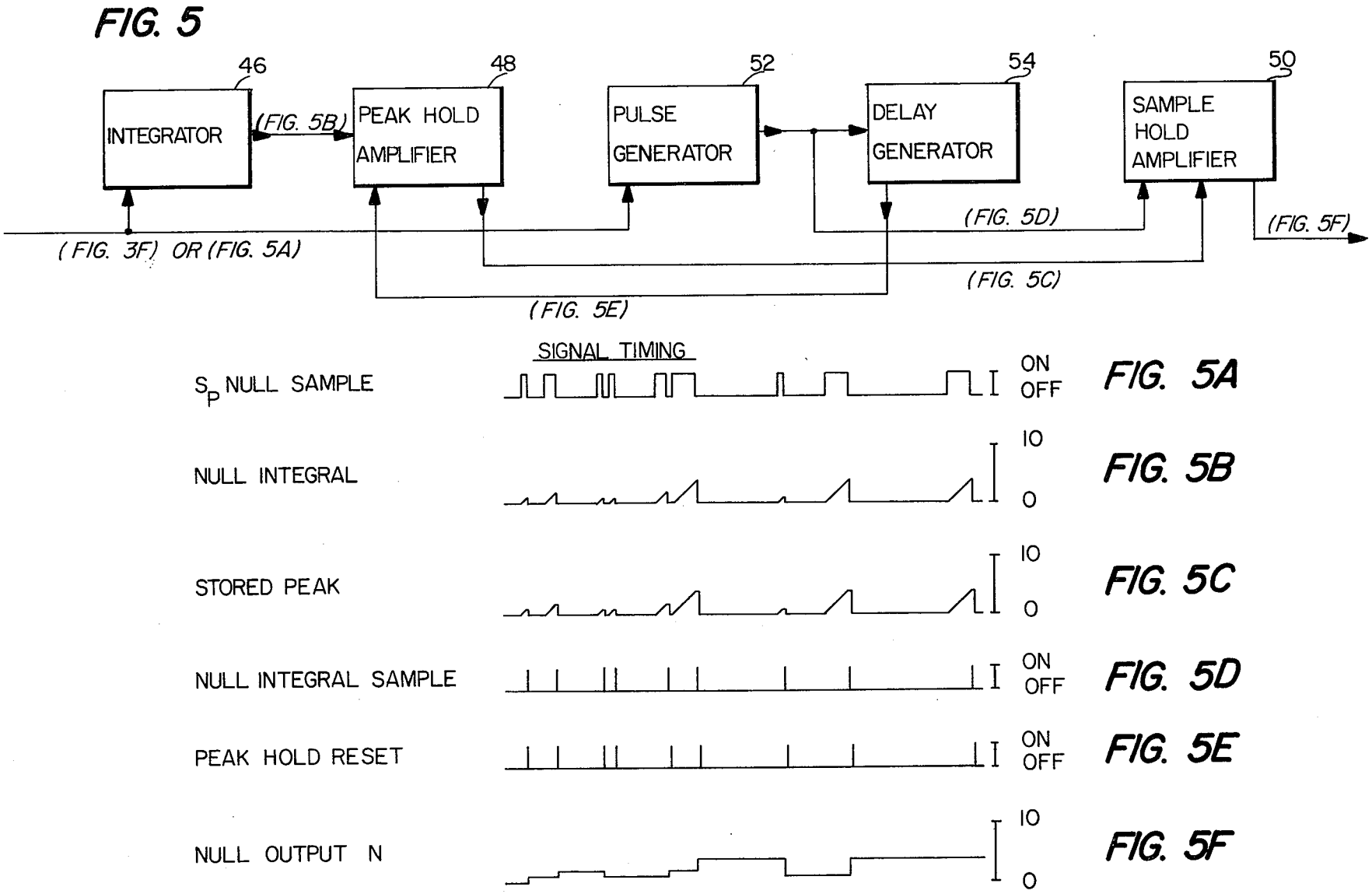
FIG. 5 is a block diagram of the pitch null duration processor of the present invention.
FIGS. 5A–5F illustrate the electrical signals associated with the elements shown in FIG. 5.

FIG. 5 illustrates the pitch null duration processor of the present invention. The output of the pitch null detector illustrated in FIGS. 3F and 5A, is applied to the input of integrator 46 which integrates the nulls and produces an output illustrated in FIG. 5B. This output is applied to a peak hold amplifier 48 which detects the peaks in the output of the integrator and produces a signal corresponding to FIG. 5C. This signal is applied to sample and hold circuit 50. The pitch null signal then is also applied to the pulse generator 52 which produces a pulse of a very short duration at the end of each null. The output of the pulse generator 52 illustrated in FIG. 5D is applied to the control input of sample and hold circuit 50 which, upon receipt of the pulse samples signal 5C which is the output of the peak hold amplifier 48 and holds this signal. This is the output 5F which corresponds to signal N. The pulses shown in FIG. 5D are also applied to a delayed pulse generator 54 which merely delays the pulse by a predetermined amount and then applies it to a reset input of peak detector 48 to reset the peak detector. Integrator 46 is a self-resetting integrator.

Figures 6, 6A, 6B, 6C, 6D, 6E, 6F, 6G, 6H:
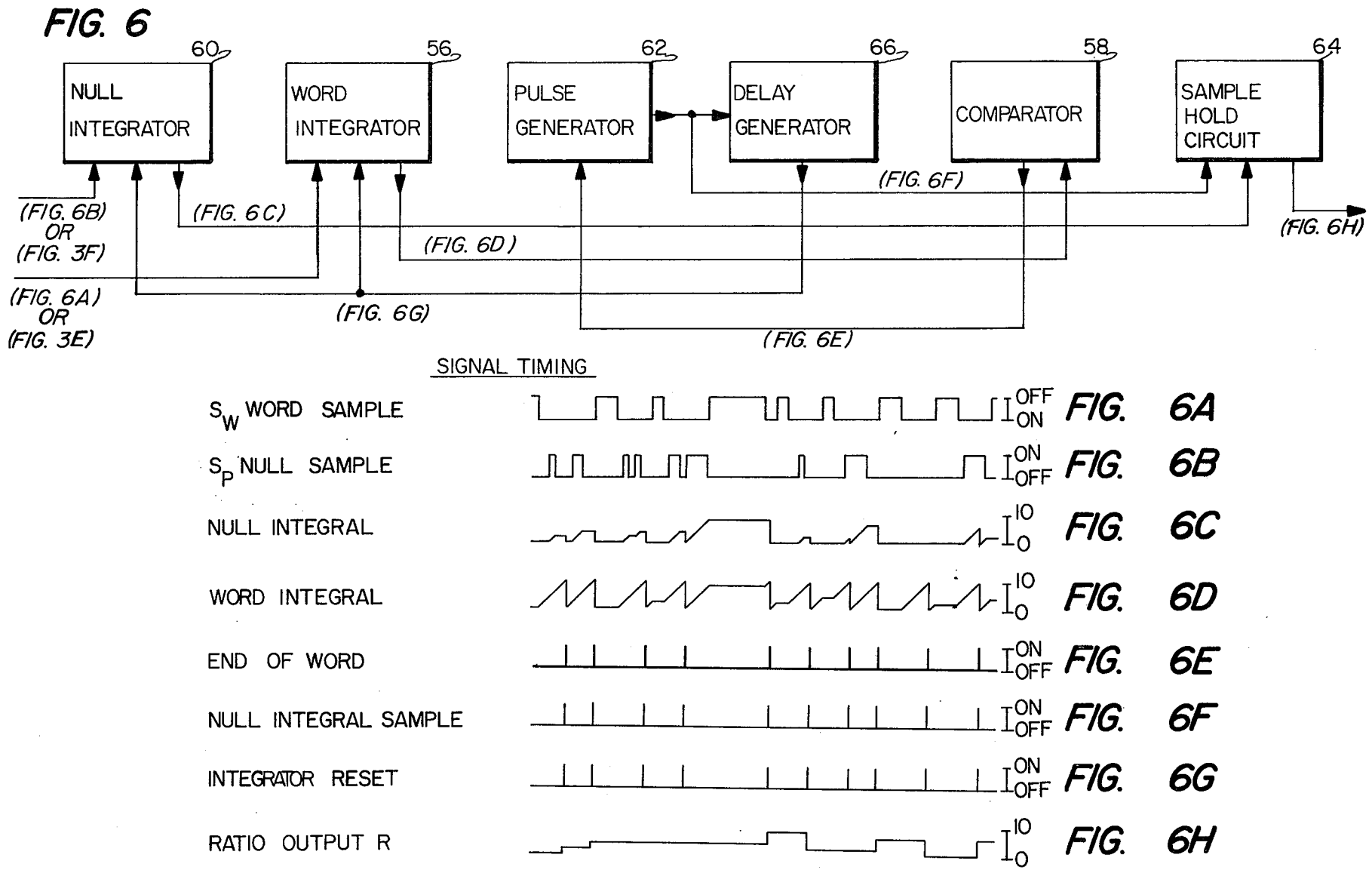
FIG. 6 is a block diagram of the ratio processor of the present invention.
FIGS. 6A–6H illustrate the electrical signals associated with the elements shown in FIG. 6.

Referring to FIG. 6, the word output of the word detector 4 as illustrated in FIG. 3E and FIG. 6A, is applied to word integrator 56. The output of word integrator 56 shown in FIG. 6D is applied to the input of comparator 58. The other output of the word and null detector for the null output is applied to null integrator 60 which integrates this signal and has its output, illustrated in FIG. 6C, applied to the input of sample and hold circuit 64. The comparator circuit 58 accumulates word segments until the sum reaches a predetermined value and then generates a pulse shown in FIG. 6E at the end of each word. This pulse causes pulse generator 62 to generate a pulse as illustrated in FIG. 6F which is applied to the control input of sample and hold circuit 64 which samples the output of null integrator 60, which is illustrated in FIG. 6G at the occurrence of each pulse in the output of the pulse generator 62. The output of sample and hold circuit 64 is illustrated in FIG. 6H and represents the ratio signal of the total duration of the nulls during a word to the duration of the word. The output of pulse generator 62 is also applied to a pulse generator 66 which produces a delayed pulse output 6G which is applied to integrators 56 and 60 to reset the integrators.

The present invention thus produces three output signals; P from the pitch frequency processor, N from the pitch null duration processor and R from the ratio processor. These three signals can be utilized to determine the emotional state of the individual whose voice is being analyzed.

Figure 7A:
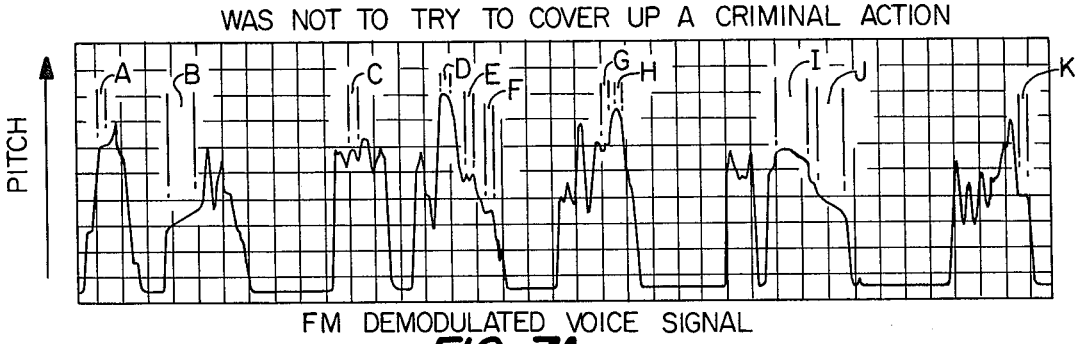
FIGS. 7A–7D are chart recordings of a speech signal analysis according to the present invention.

FIGS. 7A–7D are chart recordings made using the apparatus of the present invention. FIG. 7A is an FM demodulated voice signal. The periods A–K correspond to nulls or "flat" spots in the pitch, and the letters A–K are used to designate corresponding portions in FIGS. 7B and 7C.

Figure 7B:
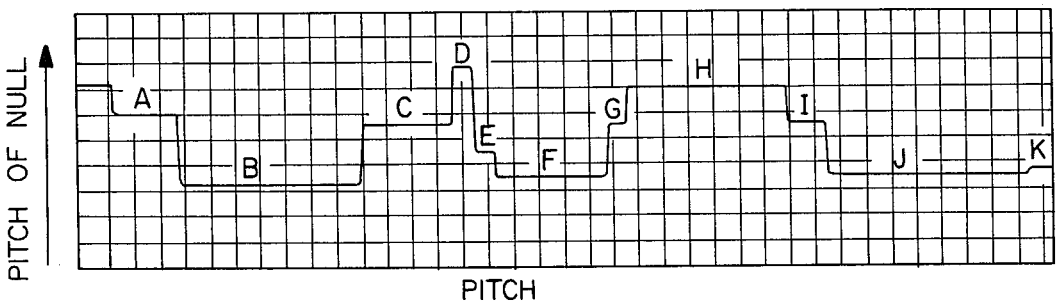

FIG. 7B illustrates the pitch processor output. The level of the output is indicative of the value of the pitch at the occurrence of a null. In FIG. 7B, the value of the output of the pitch processor does not change until the occurrence of the next null. Therefore, in the waveform, the time period between changes in the value of a pitch of a null has no bearing in the analysis.

Figure 7C:
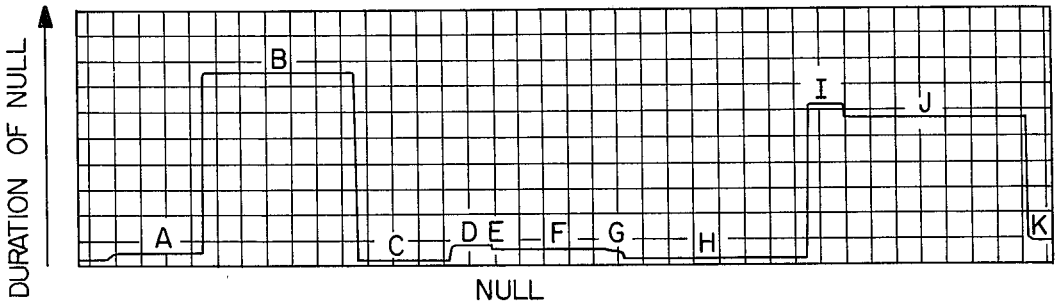

FIG. 7C is the output of the null processor. The level of the output is indicative of the duration of a null. As in the output of the pitch processor, the level of the waveform does not change until the occurrence of the next null, and thus the time between changes in the level of the waveform in FIG. 7C is immaterial to the analysis.

Figure 7D:
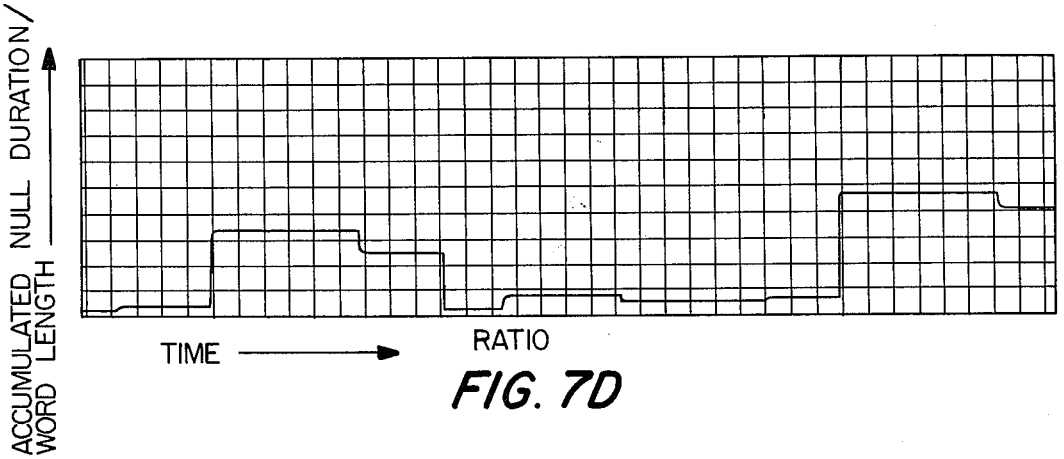

FIG. 7D illustrates the output of the ratio processor. The level of the output in FIG. 7D is indicative of the ratio of the accumulated null duration to the word length. There is no direct time correlation between the changes in ratio to the occurrence of nulls A–K, since a word is defined as a predetermined period of time, and thus a word could end, for example, in the middle of an occurrence of a null.

The four chart recordings shown in FIGS. 7A–7D when displayed on appropriate meters or other indicators can be used to provide a real time analysis of the emotional state of the individual whose voice is being analyzed.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A speech analyzer for determining the emotional state of a person, said analyzer comprising:

(a) FM demodulator means for detecting a person's speech and producing an FM demodulated signal therefrom;

(b) detector means coupled to the output of said FM demodulator means for detecting nulls in said FM demodulated signal and producing a first output indicative thereof and for detecting the presence of a word and producing a second output indicative therof;

(c) pitch frequency processor means, coupled to the output of said FM demodulator and the first output of said detector means for producing an output having an amplitude proportional to the frequency of the speech signal at said nulls;

(d) pitch null duration processor means, coupled to the first output of said detector means, for producing an output having an amplitude proportional to the duration of said nulls; and (e) ratio processor means, coupled to the first and second outputs of said detector means for producing an output proportional to the ratio of the total duration of all of said nulls within a word to the total duration of the word.

2. The speech analyzer of claim 1 wherein said detector means comprises:

(a) a differential amplifier for receiving said FM demodulated signal and for differentiating said signal;

(b) first comparator means for receiving said differentiated signal and for producing a signal indicative of the zero crossings of said differentiated signal;

(c) delay comparator means for receiving the output of said first comparator means and for producing a signal indicative of the time when the output of said first comparator means is zero for longer than a predetermined period of time;

(d) second comparator means for receiving said FM demodulated signal and for producing an output indicative of the time periods when the frequency of said FM demodulated signal is above a predetermined frequency, the output of said second comparator being said second output of said detector means; and (e) AND gate means for receiving the output of said delay comparator means and said second comparator means, and for producing an output indicative of the time periods when the output of said first comparator means is zero for longer than the predetermined period of time and when the frequency of said FM demodulated signal is above a predetermined frequency, the output of said AND gate means being said first output of said detector means.

3. The speech analyzer of claim 2 wherein said predetermined frequency is 250 Hz.

4. The speech analyzer of claim 1 wherein said pitch frequency processor means comprise:

(a) first pulse generator means for receiving the first output of said detector means and for producing a pulse each time said detector means detects a null; and (b) first sample and hold means for receiving the pulses from said first pulse generator means and for receiving said FM demodulated signal and for sampling and holding a value proportional to the amplitude of said FM demodulated signal when a pulse is received.

5. The speech analyzer of claim 1 wherein said pitch null duration processor means comprises:

(a) first integrator means for receiving the first output of said detector means and for integrating said output;

(b) peak hold amplifier means for receiving said integrated signal and for detecting the peak thereof;

(c) second pulse generator means for receiving the first output of said detector means and for producing a pulse at the end of each null;

(d) delayed pulse generator means for receiving the pulse output of said second pulse generator means and for producing an output corresponding to the output of said second pulse generator means but delayed by a predetermined amount;

(e) second sample and hold means for receiving the outputs of said peak hold amplifier means and said pulse generator means, for sampling and holding the value of the output of said peak hold amplifier means when a pulse is received from said pulse generator means, and (f) wherein the output of said delayed pulse generator means is applied to said peak hold amplifier means to reset said peak detector means after it has been sampled by said second sample and hold means.

6. The speech analyzer of claim 1 wherein said ratio processor means comprises:

(a) second integrator means for receiving the first output of said detector means and for integrating said first output;

(b) third integrator means for receiving the second output of said detector means and for integrating said second output;

(c) comparator means for producing a pulse output when the accummulated output of said third integrator reaches a predetermined value;

(d) second pulse generator means for receiving the output of said comparator means and for producing a pulse at the end of each word;

(e) third sample and hold means for receiving the output of said second pulse generator means and for sampling and holding the value of the output of said second integrator means when a pulse is received from said second pulse generator means; and (f) second delayed pulse generator means for receiving the output of said second pulse generator means and for producing a pulse output corresponding thereto but delayed by a predetermined amount, the output of said second delayed pulse generator means being applied to said second and third integrator means for resetting said second and third integrator means.

7. A speech analyzer for analyzing an FM demodulated speech signal said analyzer comprising:

(a) detector means for receiving said FM demodulated signal and for producing a first output indicative of nulls therein and for detecting the presence of a word and producing a second output indicative thereof;

(b) pitch frequency processor means, coupled to the output of said FM demodulator and the first output of said detector means for producing an output having an amplitude proportional to the frequency of the speech signal at said nulls;

(c) pitch null duration processor means, coupled to the first output of said detector means, for producing an output having an amplitude proportional to the duration of said nulls; and (d) ratio processor means, coupled to the first and second outputs of said detector means for producing an output proportional to the ratio of the total duration of all of said nulls within a word to the total duration of the word.

8. The speech analyzer of claim 7 wherein said detector means comprises:

(a) a differential amplifier for receiving said FM demodulated signal and for differentiating said signal;

(b) first comparator means for receiving said differentiated signal and for producing a signal indicative of the zero crossings of said differentiated signal;

(c) delay comparator means for receiving the output of said first comparator means and for producing a signal indicative of the time when the output of said first comparator means is zero for longer than a predetermined period of time;

(d) second comparator means for receiving said FM demodulated signal and for producing an output indicative of the time periods when the frequency of said FM demodulated signal is above a predetermined frequency, the output of said second comparator being said second output of said detector means; and (e) AND gate means for receiving the output of said delay comparator means and said second comparator means, and for producing an output indicative of the time periods when the output of said first comparator means is zero for longer than the predetermined period of time and when the frequency of said FM demodulated signal is above a predetermined frequency, the output of said AND gate means being said first output of said detector means.

9. The speech analyzer of claim 8 wherein said predetermined frequency is 250 Hz.

10. The speech analyzer of claim 7 wherein said pitch frequency processor means comprise:

(a) first pulse generator means for receiving the first output of said detector means and for producing a pulse each time said detector means detects a null; and (b) first sample and hold means for receiving the pulses from said first pulse generator means and for receiving said FM demodulated signal and for sampling and holding a value proportional to the amplitude of said FM demodulated signal when a pulse is received.

11. The speech analyzer of claim 7 wherein said pitch null duration processor means comprises:

(a) first integrator means for receiving the first output of said detector means and for integrating said output;

(b) peak hold amplifier means for receiving said integrated signal and for detecting the peak thereof;

(c) second pulse generator means for receiving the first output of said detector means and for producing a pulse at the end of each null;

(d) delayed pulse generator means for receiving the pulse output of said second pulse generator means and for producing an output corresponding to the output of said second pulse generator means but delayed by a predetermined amount;

(e) second sample and hold means for receiving the outputs of said peak hold amplifier means and said pulse generator means, for sampling and holding the value of the output of said peak detector means when a pulse is received from said pulse generator means, and (f) wherein the output of said delayed pulse generator means is applied to said peak detector means to reset said peak detector means after it has been sampled by said second sample and hold means.

12. The speech analyzer of claim 7 wherein said ratio processor means comprises: p1 (a) second integrator means for receiving the first output of said detector means and for integrating said first output;

(b) third integrator means for receiving the second output of said detector means and for integrating said second output;

(c) comparator means for producing a pulse output when the accummulated output of said third integrator reaches a predetermined value;

(d) second pulse generator means for receiving the output of said comparator means and for producing a pulse at the end of each word;

(e) third sample and hold means for receiving the output of said second pulse generator means and for sampling and holding the value of the output of said second integrator means when a pulse is received from said second pulse generator means; and (f) second delayed pulse generator means for receiving the output of said second pulse generator means and for producing a pulse output corresponding thereto but delayed by a predetermined amount, the output of said second delayed pulse generator means being applied to said second and third integrator means for resetting said second and third integrator means.

* * * * *